US005597687A

United States Patent [19]

Dobles et al.

[11] Patent Number: 5,597,687

[45] Date of Patent: Jan. 28, 1997

[54] SENSITIZING DYE COMBINATION FOR PHOTOGRAPHIC MATERIALS

[75] Inventors: Thomas R. Dobles, Hilton; David A. DuMont, Rochester; Paul B. Gilman, Penfield; Sang H. Kim, Pittsford; Steven G. Link, Rochester; Richard L. Parton, Webster, all of N.Y.

[73] Assignee: Eastman Kodak Company, Rochester, N.Y.

[21] Appl. No.: 545,368

[22] Filed: Oct. 19, 1995

Related U.S. Application Data

[63] Continuation of Ser. No. 182,840, Jan. 13, 1994, abandoned, which is a continuation of Ser. No. 568,382, Aug. 16, 1990, abandoned.

[51] Int. Cl.[6] ..... G03C 1/29

[52] U.S. Cl. ..... 430/574; 430/567; 430/583; 430/584; 430/586

[58] Field of Search ..... 430/574, 588, 430/586, 584, 583, 567

[56] References Cited

U.S. PATENT DOCUMENTS

| | | | |
|---|---|---|---|
| 3,424,586 | 1/1969 | Gotze | 430/588 |
| 3,527,641 | 9/1970 | Nakazawa et al. | 430/574 |
| 3,576,641 | 4/1971 | Sakazume et al. | 430/588 |
| 3,660,099 | 5/1972 | Sato et al. . | |
| 3,667,960 | 6/1972 | Shiba et al. . | |
| 3,920,458 | 11/1975 | Shiba et al. | 430/574 |
| 3,969,116 | 7/1976 | Shiba et al. | 430/572 |
| 4,704,351 | 11/1987 | Takiguchi et al. | 430/574 |

FOREIGN PATENT DOCUMENTS

| | | |
|---|---|---|
| 71.47530 | 8/1972 | France . |
| 19 29 037.0 | 5/1970 | Germany . |
| 1345010 | 1/1974 | United Kingdom . |

OTHER PUBLICATIONS

CRC Handbook Of Chemistry & Physics 63rd Edition Ed. R. Weast (1982) p. D–164.

P. Gilman, Review of the Mechanisms of Supersensitization, Photographic Science and Engineering, 18, pp. 418–430, Jul./Aug. 1974.

T. Penner & P. Gilman, Spectral Shifts and Physical Layering of Sensitizing Dye Combinations in Silver Halide Emulsions, 20, pp. 97–106, May/Jun. 1976.

James, The Theory of the Photographic Process, 4th Ed., pp. 259–265, 1977.

*Primary Examiner*—Janis L. Dote
*Attorney, Agent, or Firm*—Edith A. Rice

[57] ABSTRACT

A supersensitizing dye combination for silver halide photographic materials is disclosed. The combination is of a first dye according to the formula:

(I)

$Z_1$ and $Z_2$ each independently represents the atoms necessary to complete a substituted or unsubstituted heterocyclic nucleus, each L independently represents a substituted or unsubstituted methine group, n is a positive integer of from 1 to 4, p and q each independently represents 0 or 1, X represents a cation as needed to balance the charge of the molecule, A and A' each independently represents a divalent linking group such that at least one of H—A—$SO_3H$ and H—A'—$SO_3H$ would each have a log P value that is more negative than –0.3, and a second dye, having an oxidation potential that is at least about 0.08 volts less positive than the oxidation potential of the first dye and a reduction potential that is equal to or more negative than the reduction potential of the first dye, according to the formula:

(II)

$Z_3$ and $Z_4$ each independently represents the atoms necessary to complete a substituted or unsubstituted heterocyclic nucleus, each L independently represents a substituted or unsubstituted methine group, m is a positive integer of from 1 to 4, r and s each independently represents 0 or 1, X' represents a counterion as needed to balance the charge of the molecule, $R_3$ and $R_4$ each independently represents substituted or unsubstituted alkyl or substituted or unsubstituted aryl.

10 Claims, No Drawings

SENSITIZING DYE COMBINATION FOR PHOTOGRAPHIC MATERIALS

This is a Continuation of U.S. application Ser. No. 08/182,840, filed 13 Jan. 1994, now abandoned, which is a Continuation of U.S. application Ser. No. 07/568,382, filed 16 Aug. 1990, now abandoned.

FIELD OF THE INVENTION

This invention relates to photography, and particularly to the spectral sensitization of silver halide photographic materials.

BACKGROUND OF THE INVENTION

Silver halide photography usually involves the exposure of silver halide with light in order to form a latent image that is developed during photographic processing to form a visible image. Silver halide is intrinsically sensitive only to light in the blue region of the spectrum. Thus, when silver halide is to be exposed to other wavelengths of radiation, such as green or red light in a multicolor element or infrared radiation in an infrared-sensitive element, a spectral sensitizing dye is required. Sensitizing dyes are chromophoric compounds (usually cyanine dye compounds) that are adsorbed to the silver halide. They absorb light or radiation of a particular wavelength and transfer the energy to the silver halide to form the latent image, thus effectively rendering the silver halide sensitive to radiation of a wavelength other than the blue intrinsic sensitivity. Sensitizing dyes can also be used to augment the sensitivity of silver halide in the blue region of the spectrum.

Spectral sensitizing dyes such as cyanine dyes are often used as combinations of dyes to achieve varying effects. For example, combinations of dyes can be used to provide emulsions with spectral sensitivity curves (a plot of sensitivity versus wavelength of exposure) that could not be easily obtained with a single dye. In other cases, a combination of dyes can be used to sensitize an emulsion to a greater degree than possible with either of the dyes alone or even greater than the predicted additive effect of the dyes. This phenomenon is known as supersensitization. Supersensitization and supersensitizing dye combinations have been widely discussed in the art. See, for example, P. Gilman, Review of the Mechanisms of Supersensitization, Photographic Science and Engrg., 18, pp. 418–430, July/August, 1974, T. Penner & P. Gilman, Spectral Shifts and Physical Layering of Sensitizing Dye Combinations in Silver Halide Emulsions, Photographic Science and Engrg., 20, pp. 97–106, May/June, 1976, and James, *The Theory Of the Photographic Process* 4th, pp. 259–265, 1977.

U.S. Pat. No. 3,527,641 of Nakazawa et al describes supersensitizing combinations of trimethine cyanine dyes. The supersensitizing effect is purportedly achieved by manipulation of the back ring substituents on the heterocyclic rings of these dyes, with a general teaching that essentially any known substituent may be utilized as the nitrogen substituent on these dyes. Such an approach does nothing, however, to alleviate the problem of retained dye stain.

During processing of color photographic materials, the silver halide is removed from the material. With black and white materials, the silver halide that was not exposed is removed. In either case, it is desirable to remove the sensitizing dye as well. Sensitizing dye that is not removed tends to cause retained dye stain, which adversely affects the image recorded in the photographic material. The problem of retained sensitizing dye stain is further aggravated by the increasing use of tabular grain emulsions and high chloride emulsions. Tabular grain emulsions have a high surface area per mole of silver, which can lead to higher levels of sensitizing dye and thus, higher levels of retained sensitizing dye stain. High chloride emulsions necessitate the use of sensitizing dyes having enhanced adsorption to silver halide, which can also lead to higher levels of dye stain. High chloride emulsions are also often subjected to rapid processing, which can aggravate dye stain problems.

It is thus an object of this invention to provide effective supersensitizing dye combinations of photographic sensitizers that also exhibit comparatively low dye stain.

SUMMARY OF THE INVENTION

The present invention provides for a supersensitizing dye combination for silver halide photographic materials of a first dye according to the formula:

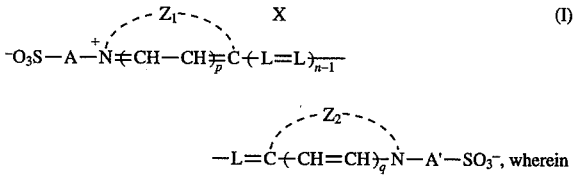

(I)

$Z_1$ and $Z_2$ each independently represents the atoms necessary to complete a substituted or unsubstituted heterocyclic nucleus, each L independently represents a substituted or unsubstituted methine group, n is a positive integer of from 1 to 4, p and q each independently represents 0 or 1, X represents a cation as needed to balance the charge of the molecule, A and A' each independently represents a divalent linking group such that at least one of H—A—$SO_3H$ and H—A'—$SO_3H$ would each have a log P value that is more negative than about –0.3, and a second dye, having an oxidation potential that is at least about 0.08 volts less positive than the oxidation potential of the first dye and a reduction potential that is equal to or more negative than the reduction potential of the first dye, according to the formula:

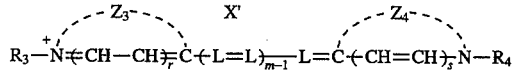

(II)

$Z_3$ and $Z_4$ each independently represents the atoms necessary to complete a substituted or unsubstituted heterocyclic nucleus, each L independently represents a substituted or unsubstituted methine group, m is a positive integer of from 1 to 4, r and s each independently represents 0 or 1, X' represents a counterion as needed to balance the charge of the molecule, $R_3$ and $R_4$ each independently represents substituted or unsubstituted alkyl or substituted or unsubstituted aryl.

The combination of the above-described dyes, with the —A—$SO_3^-$ and —A'$SO_3^-$ nitrogen substituents on the dye having a more positive oxidation potential, provides effective supersensitization of silver halide emulsions while substantially alleviating the problem of retained dye stain.

DESCRIPTION OF THE PREFERRED EMBODIMENTS

In the above formulas, $Z_1$ and $Z_2$ each independently represents the atoms necessary to complete a substituted or unsubstituted 5- or 6-membered heterocyclic nucleus. These include a substituted or unsubstituted: thiazole nucleus, oxazole nucleus, selenazole nucleus, quinoline nucleus, tellurazole nucleus, pyridine nucleus, thiazoline nucleus, indoline nucleus, oxadiazole nucleus, thiadiazole nucleus, or imidazole nucleus. This nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art.

Examples of useful nuclei for $Z_1$ and $Z_2$ include: a thiazole nucleus, thiazole, 4-methylthiazole, 4-phenylthiazole, 5-methylthiazole, 5-phenylthiazole, 4,5-dimethyl-thiazole, 4,5-diphenylthiazole, 4-(2-thienyl)thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5-methoxybenzothiazole, 6-methoxybenzothiazole, 4-ethoxybenzothiazole, 5-ethoxybenzothiazole, tetrahydrobenzothiazole, 5,6-dimethoxybenzothiazole, 5,6-dioxymethylenebenzothiazole, 5-hydroxybenzothiazole, 6-hydroxybenzothiazole, naphtho[2,1-d]thiazole, naptho[1,2-d]thiazole, 5-methoxynaphtho[2,3-d]thiazole, 5-ethoxynaphtho[2,3-d]thiazole, 8-methoxynaphtho[2,3-d]thiazole, 7-methoxynaphtho[2,3-d]thiazole, 4'-methoxythianaphtheno-7',6'-4 5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole 5-ethoxybenzoxazole, 5-chlorobenzoxazole, 6-methoxybenzoxazole, 5-hydroxybenzoxazole, 6-hydroxybenzoxazole,naphtho[2,1-d]oxazole, naphtho[1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g., 2-pyridine, 5-methyl-2-pyridine, 4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, 8-chloro-4-quinoline, etc.; a tellurazole nucleus, e.g., benzotellurazole, naphtho[1,2-d]benzotellurazole, 5,6-dimethoxybenzotellurazole, 5-methoxybenzotellurazole, 5-methylbenzotellurazole; a thiazoline nucleus, e.g., thiazoline, 4-methylthiazoline, etc; a benzimidazole nucleus, e.g., benzimidazole, 5-trifluoromethylbenzimidazole, 5,6-dichlorobenzimidazole; an indole nucleus, 3,3-dimethylindole, 3,3-diethylindole, 3,3,5-trimethylindole; or a diazole nucleus, e.g., 5-phenyl-l,3,4-oxadiazole, 5-methyl-l,3,4-thiadiazole.

According to formulas (I) and (II), each L represents a substituted or unsubstituted methine group. Examples of substituents for the methine groups include alkyl (preferably of from 1 to 6 carbon atoms, e.g., methyl, ethyl, etc.) and aryl (e.g., phenyl). Additionally, substituents on the methine groups may form bridged linkages.

X represents a cation as necessary to balance the charge of the dye molecule. Such cations are well-known in the art. Examples include sodium, potassium, triethylammonium, and the like. X' represents a counterion as necessary to balance the charge of the molecule. The counterion may be ionically complexed to the molecule or it may be part of the dye molecule itself to form an intramolecular salt. Such counterions are well-known in the art. For example, when X' is an anion (e.g., when $R_3$ and $R_4$ are unsubstituted alkyl), examples of X' include chloride, bromide, iodide, p-toluene sulfonate, methane sulfonate, methyl sulfate, ethyl sulfate, perchlorate, and the like. When X' is a cation (e.g., when $R_1$ and $R_2$ are both sulfoalkyl or carboxyalkyl), examples of X' include those described above for X.

$R_3$ and $R_4$ each independently represents substituted or unsubstituted aryl (preferably of 6 to 15 carbon atoms), or more preferably, substituted or unsubstituted alkyl (preferably of from 1 to 6 carbon atoms). Examples of aryl include phenyl, tolyl, p-chlorophenyl, and p-methoxyphenyl. Examples of alkyl include methyl, ethyl, propyl, isopropyl, butyl, hexyl, cyclohexyl, decyl, dodecyl, etc., and substituted alkyl groups (preferably a substituted lower alkyl containing from 1 to 6 carbon atoms), such as a hydroxyalkyl group, e.g., 2-hydroxyethyl, 4-hydroxybutyl, etc., an alkoxyalkyl group, 2-methoxyethyl, 4-butoxybutyl, etc., a carboxyalkyl group, e.g., 2-carboxyethyl, 4-carboxybutyl, etc.; a sulfoalkyl group, e.g., 2-sulfoethyl, 3-sulfobutyl, 4-sulfobutyl, etc., a sulfatoalkyl group, 2-sulfatoethyl, 4-sulfatobutyl, etc., an acyloxyalkyl group, e.g., 2-acetoxyethyl, 3-acetoxypropyl, 4-butyryloxybutyl, etc., an alkoxycarbonylalkyl group, e.g., 2-methoxycarbonylethyl, 4-ethoxycarbonylbutyl, etc., or an aralkyl group, e.g., benzyl, phenethyl, etc. The alkyl or aryl group may be substituted by one or more of the substituents on the above-described substituted alkyl groups.

According to formulas (I), A and A' each independently represents a divalent linking group such that at least one of H—A-$SO_3H$ and H—A'—$SO_3H$ would each (and preferably both) have a log P value that is more negative than about −0.3. In a preferred embodiment, at least one of H—A—$SO_3H$ and H—A'—$SO_3H$ each (and preferably both) have a log P value that is more negative than about −1.0. The log P parameter is a well-known measurement of the tendency of a compound to be partitioned in the nonpolar phase versus the aqueous organic phase of an organic/aqueous mixture. The log P parameter is further described, along with log P data for organic compounds, in C. Hansch & T. Fujita, J. Am. Chem. Soc., 86, 1616–25 (1964) and A Leo & C. Hansch, *Substituent Constants for Correlation Analysis in Chemistry and Biology, Wiley*, New York (1979), the disclosures of which are incorporated herein by reference. For purposes of the present invention, what is meant by log P is the octanol/water log P value calculated by the methodology described in the above-referenced Hansch *Substituent Constants* book using the commercially-available Medchem software package, release 3.54, developed and distributed by Pomona College, Claremont, Calif.

Linking groups useful as A and A', and the calculated log P values for the corresponding acids H—A—$SO_3H$ and H—A'—$SO_3H$, include:

a hydroxy-containing substituent, for example:

$-CH_2-CH(OH)CH_2-$ (−1.40)  $-CH_2-CH_2-CH(OH)CH_2-$ (−0.87)

$-CH_2-CH(OH)CH_2CH_2-$ (−1.84)

an amide-containing substituent, for example:

$-CH_2-C(=O)-NHCH_2CH_2-$ (−1.75)

$-CH_2-CH=CH-C(=O)-NHCH_2CH_2-$ (−0.90)

$-CH_2-C(=O)-NHCH_2-$ (−1.99)

$-CH_2CH_2NH-C(=O)-CH_2CH_2-$ (−1.22)

$-CH_2-C(=O)-N(CH_3)CH_2CH_2-$ (−1.35)

an ether-containing substituent, for example:

$-CH_2CH_2-O-CH_2CH_2-$ (−0.56)

$-CH_2CH_2-O-CH_2CH_2CH_2-$ (−1.05)

a carboxylic ester-containing substituent, for example:

$-CH_2-C(=O)-OCH_2CH_2-$ (−0.84)

$-CH_2-C(=O)-OCH_2CH_2CH_2-$ (−1.25)

a sulfonamide-containing substituent, for example:

$-CH_2CH_2CH_2-SO_2-NHCH_2CH_2-$ (−0.53)

$-CH_2CH_2CH_2-SO_2NHCH_2CH_2CH_2-$ (−1.20)

a urea-containing substituent, for example:

$-CH_2CH_2NH-C(=O)-NHCH_2CH_2-$ (−0.82)

$-CH_2CH_2NH-C(=O)-NHCH_2CH_2CH_2-$ (−1.41)

a sulfonyl-containing substituent, for example:

$-CH_2CH_2CH_2-S(=O)_2-CH_2CH_2-$ (−0.94)

$-CH_2CH_2CH_2-S(=O)_2-CH_2CH_2CH_2-$ (−1.75)

a sulfoxide containing substituent, for example:

$-CH_2CH_2CH_2-S(=O)-CH_2CH_2-$ (−0.91)

$-CH_2CH_2CH_2-S(=O)-CH_2CH_2CH_2-$ (−1.71)

a urethane containing substituent, for example:

$-CH_2CH_2O-C(=O)-NHCH_2-$ (−0.82)

$-CH_2CH_2NH-C(=O)-OCH_2CH_2CH_2-$ (−1.02)

or combinations of the above substituents, for example:

$-CH_2-C(=O)-NHCH_2CH_2CH(OH)CH_2-$ (−2.57)

$-CH_2-C(=O)-NHCH_2CH_2OCH_2CH_2-$ (−1.68)

One preferred class of A and A' groups are amide-containing substituents as described in U.S. patent application Ser. No. 07/554,649 of Parton et al, entitled "Sensitizing Dyes for Photographic Elements", the disclosure of which is incorporated herein by reference.

According to the present invention, the dyes of formulas (I) and (II) are selected so that the oxidation potential of the dye according to formula (II) is at least about 0.08 volts less positive than the oxidation potential of the dye of formula (I), and preferably at least about 0.1 volts less positive than the oxidation potential of the formula (I) dye. The reduction potential of the dye of formula (II) is equal to or more negative, and preferably more negative, than the dye of formula (I).

The oxidation and reduction potentials of cyanine dyes, and the measurement and estimation thereof, has been widely studied and published in the art. For example, the determination of redox potentials through the use of molecular orbital calculations to estimate the relative positions of the highest filled and lowest vacant energy levels is described by T. Tani, K. Nakai, K. Honda, and S. Kikuchi, Denki Kagaku, 34, 149 (1966); T. Tani, S. Kikuchi, and K. Hosoya, Kogyo Kagaku Zasshi, 71, 322 (1968); and D. Sturmer, W. Gaugh, and 3. Bruschi, Photogr. Sci. Eng., 18, 49, 56 (1974). The measurement of redox potentials with phase-selective second-harmonic AC voltammetry is described by J. Lenhard, J. Imaging Sci., 30, 27 (1986).

In the practice of the present invention, oxidation and reduction potentials are preferably calculated through the use of Brooker deviations. The Brooker deviation value is well-known in the art, relating the absorption characteristics of unsymmetrical cyanine dyes to the electron donating abilities of the various heterocycles. Brooker deviations are discussed in detail in James, *The Theory of the Photographic Process* 4th, 198–200, 1977 and L. Brooker, Rev. Modern Phys., 14, 275 (1942), the disclosures of which are incorporated herein by reference. The use of Brooker deviations to calculate oxidation and reduction potentials is described by S. Link, "A Simple Calculation of Cyanine Dye Redox Potentials," p. F-73 of the abstract book published at the International East-West Symposium on the Factors Influencing Photographic Sensitivity, co-sponsored by the SPSE (Society of Imaging Science and Technology) and the Soc. of Photographic Sci. and Tech. of Japan, Oct. 30–Nov. 4, 1988, Kona, Hawaii, the disclosure of which is incorporated herein by reference. The oxidation and reduction potentials in volts referenced to silver chloride are calculated from the following equations:

For simple cyanine dyes:

$$E_{ox}=-0.00505\ (Dev\ 1+Dev\ 2)+1.917$$

$$E_{red}=-0.0106\ (Dev\ 1+Dev\ 2)-1.57\ E_s+4.268$$

For carbocyanines other than imidazole-containing nuclei:

$$E_{ox}=-0.00362\ (Dev\ 1+Dev\ 2)+1.313$$

$$E_{red}=-0.00269\ (Dev\ 1+Dev\ 2)-0.922\ E_s+1.292$$

For carbocyanines with imidazole-containing nuclei:

$$E_{ox}=-0.00309\ (Dev\ 1+Dev\ 2)+1.395$$

$$E_{red}=-0.00363\ (Dev\ 1+Dev\ 2)-0.682\ E_s+0.997$$

For dicarbocyanines:

$$E_{ox}=-0.00224\ (Dev\ 1+Dev\ 2)+0.879$$

$$E_{red}=-0.00181\ (Dev\ 1+Dev\ 2)-0.711\ E_s+0.641$$

For tricarbocyanines:

$$E_{ox}=-0.00243\ (Dev\ 1+Dev\ 2)+0.705$$

$$E_{red}=-0.0029\ (Dev\ 1+Dev\ 2)-1.063\ E_s+1.276$$

In these equations, Dev 1 and Dev 2 are the Brooker deviations in nm of the heterocyclic rings which make up the dye chromophore, and $E_s$ is the spectral transition of the dye: $E_s=1240/\lambda max$ where $\lambda max$ is the wavelength in nm of the maximum absorption of light by the dye in methanol solution.

Examples of Brooker deviations for heterocyclic rings of dyes useful in the practice of the invention include:

| Heterocycle | Brooker Deviation |
|---|---|
| 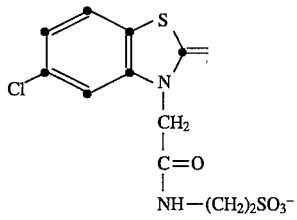 | 39.8 nm |
| 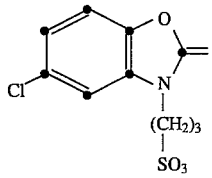 | 40.6 nm |
| 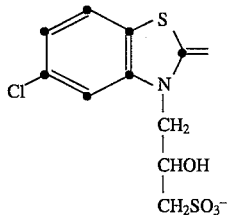 | 41.6 nm |
| 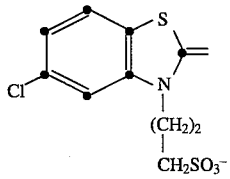 | 43.8 nm |
| 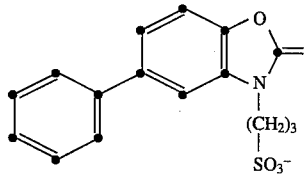 | 48.2 nm |
| 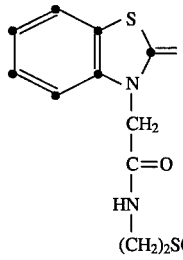 | 50 nm |
| 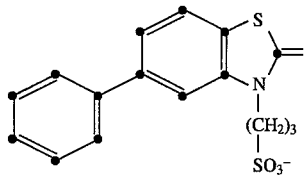 | 54.8 nm |

-continued

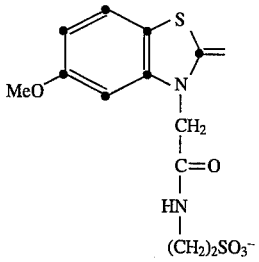

56.4 nm

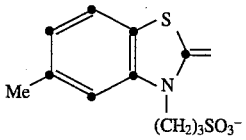

58 nm

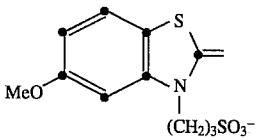

60.6 nm

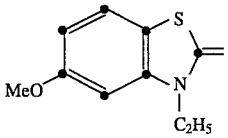

62 nm

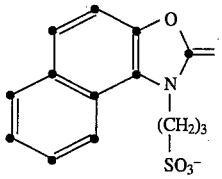

62.6 nm

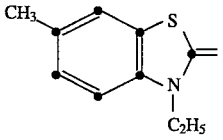

62.6 nm

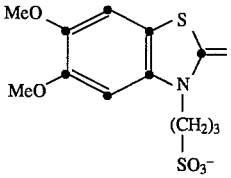

82.2 nm

In a preferred embodiment of the invention, the first dye used in the practice of the invention has the formula:

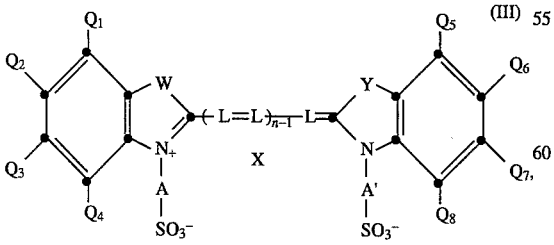

(III)

and the second dye has the formula:

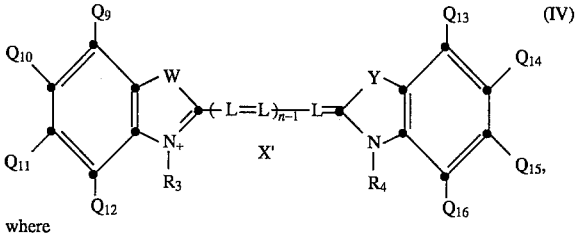

(IV)

where

L, A, A', X X', $R_3$ and $R_4$ are as defined above for formulas (I) and (II),

W and Y each independently represents O, S, Se, or N-$R_1$ where $R_1$ represents substituted or unsubstituted alkyl, Q1–Q16 represent substituents such that $$\Sigma\sigma_p(Q_1 \rightarrow Q_8) - \Sigma\sigma_p(Q_9 \rightarrow Q_{16}) > 0.65,$$

where $\sigma_p$ is the Hammet's sigma constant for the various Q substituents (Hammet's sigma constants are well-known in the art and are described, for example, in the above-referenced Leo & Hansch book), and n is 2 or 3.

The available substituents for the heterocyclic rings of cyanine dyes from which the Q substituents can be chosen are well-known in the art. Q substituents which can tend to yield the required differential of the sum of the Hammet's sigma constants include, for $Q_1$–$Q_8$: H, halogen, aryl, $CF_3$, cyano, sulfonyl, acyl, or carbamoyl, and for $Q_9$–$Q_{16}$: H, lower alkyl, methoxy, ethoxy, acetoxy, hydroxy, acetamido, or amino. If however, $Q_1$–$Q_8$ are all H, then $Q_9$–$Q_{16}$ cannot also be all H.

In a particularly preferred embodiment, the first dye has the formula:

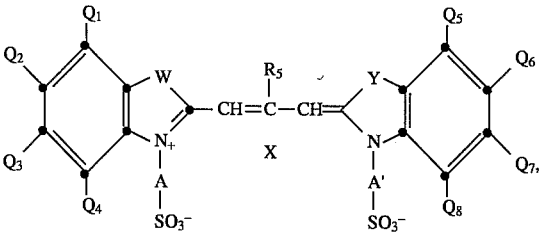

(V)

and the second dye has the formula:

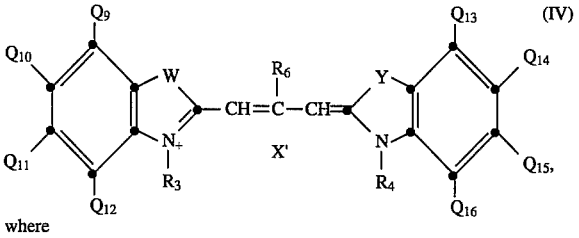

(IV)

where

A, A', X X', $Q_1$–$Q_{16}$, $R_3$, and $R_4$ are as defined above for formulas (III) and (IV), W and Y each independently represents O, S, Se, or N-$R_1$ where $R_1$ represents substituted or unsubstituted alkyl, and at least one of W and Y is S or Se, and $R_5$ and $R_6$ each independently represents H, substituted or unsubstituted alkyl, or substituted or unsubstituted aryl.

In another preferred embodiment, the first dye has the formula:

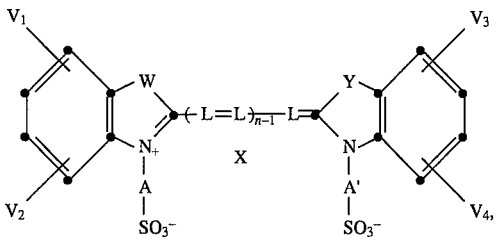

(VII)

and the second dye has the formula:

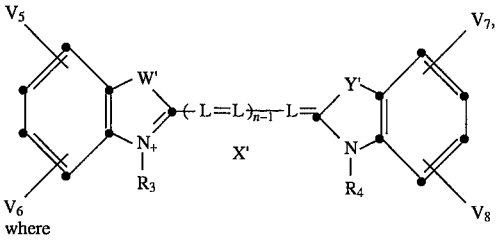

(VIII)

where

A, A', X, X', L, n, $R_3$, and $R_4$ are as defined above for formulas (III) and (IV), W, W', Y, and Y' each independently represents O, S, Se, or N—$R_1$ where $R_1$ represents substituted or unsubstituted alkyl, $V_1$, $V_2$, $V_3$, and $V_4$ each independently represents H, halogen, aryl, $CF_3$, cyano, sulfonyl, acyl, carbamoyl, or $V_1$ and $V_2$ or $V_3$ and $V_4$ may together form a substituted or unsubstituted benzene ring structure, and $V_5$, $V_6$, $V_7$, and $V_8$ each independently represents H, lower alkyl, methoxy, ethoxy, acetoxy, hydroxy, acetamido, amino, or $V_5$ and $V_6$ or $V_7$ and $V_8$ may together form a methylenedioxy group or a substituted or unsubstituted benzene ring structure, with the proviso that if $V_1$, $V_2$, $V_3$, and $V_4$ are all H or all form benzene ring structures, then $V_5$, $V_6$, $V_7$, and $V_8$ are not all H.

In another particularly preferred embodiment, the first dye has the formula:

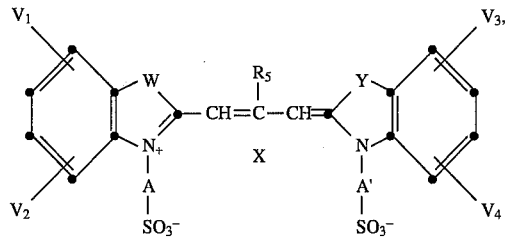

(IX)

and the second dye has the formula:

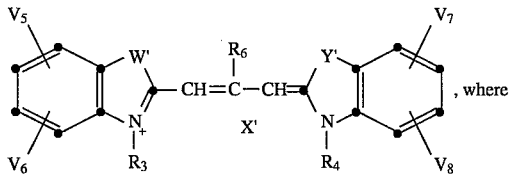

(X)

, where

A, A', X, X', $R_3$, $R_4$, and $V_1$–$V_8$ are as defined above for formulas (VII) and (VIII), $R_5$ and $R_6$ are as defined above for formulas (V) and (VI), and W W', Y and Y' each independently represents O, S, Se, or N—$R_1$ where $R_1$ represents substituted or unsubstituted alkyl, and at least one of W and Y and at least one of W' and Y' is S or Se.

Examples of dye combinations useful in the practice of the invention along with their calculated oxidation and reduction potentials include:

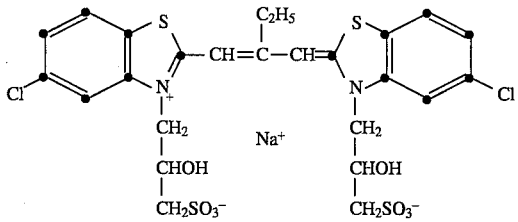

(I)-1

$E_{ox}$ = +1.012 V
$E_{red}$ = −1.003 V and

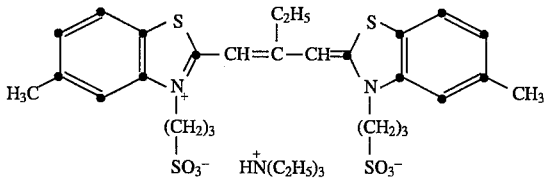

(II)-1

$E_{ox}$ = +0.893 V
$E_{red}$ = −1.095 V

-continued
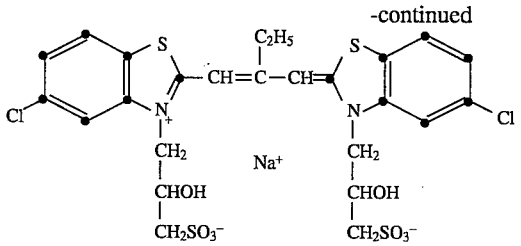
(I)-1
$E_{ox}$ = +1.012 V
$E_{red}$ = −1.003 V
and
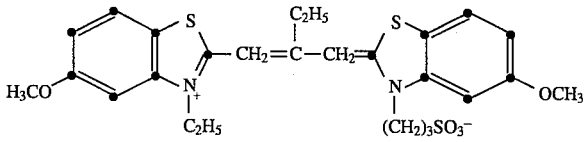
(II)-2
$E_{ox}$ = +0.869 V
$E_{red}$ = −1.068 V
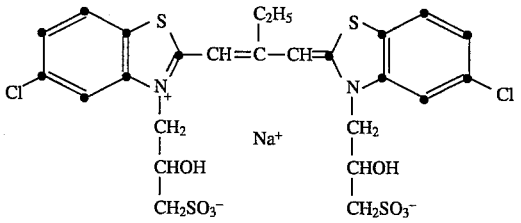
(I)-1
$E_{ox}$ = +1.012 V
$E_{red}$ = −1.003 V
and
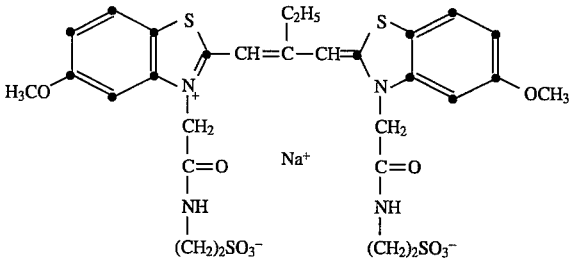
(II)-3
$E_{ox}$ = +0.905 V
$E_{red}$ = −1.003 V
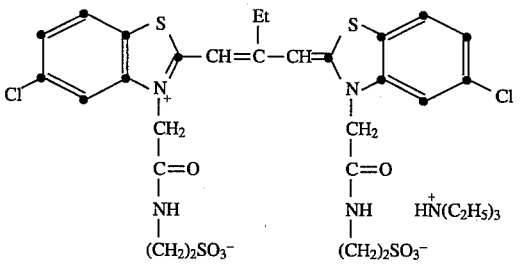
(I)-2
$E_{ox}$ = +1.025 V
$E_{red}$ = −0.950 V
and -continued
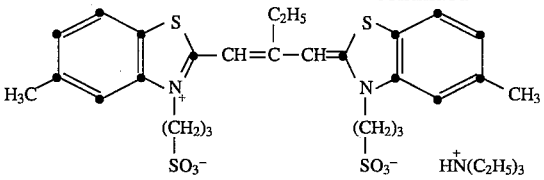
(II)-1
$E_{ox}$ = +0.893 V
$E_{red}$ = −1.095 V
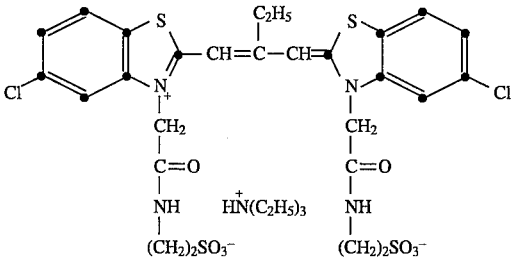
(I)-2
$E_{ox}$ = +1.025 V
$E_{red}$ = −0.950 V
and
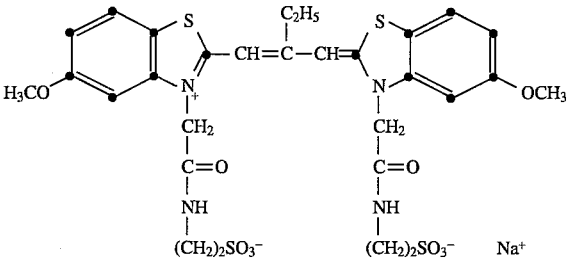
(II)-3
$E_{ox}$ = +0.905 V
$E_{red}$ = −1.003 V
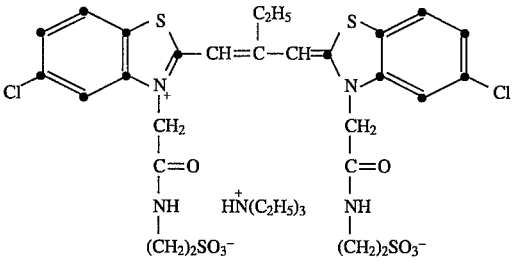
(I)-2
$E_{ox}$ = +1.025 V
$E_{red}$ = −0.950 V
and
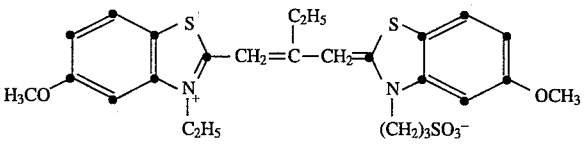
(II)-2
$E_{ox}$ = +0.869 V
$E_{red}$ = −1.068 V -continued

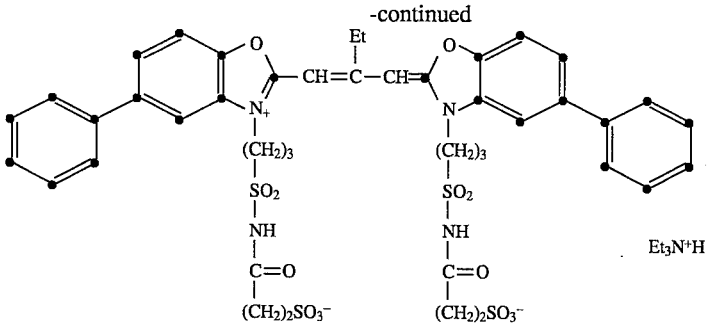

(I)-3

$E_{ox}$ = +0.964 V
$E_{red}$ = −1.254 V and

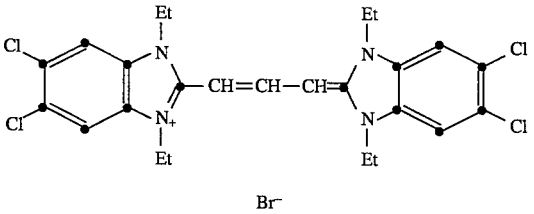

(II)-4

$E_{ox}$ = +0.653 V
$E_{red}$ = −1.519 V

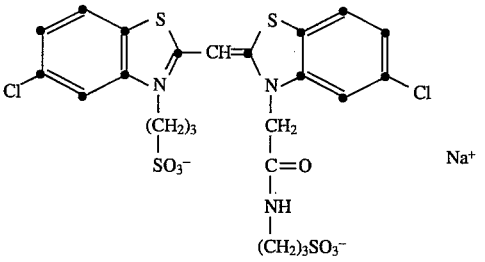

(I)-4

$E_{ox}$ = +1.511 V
$E_{red}$ = −1.122 V and

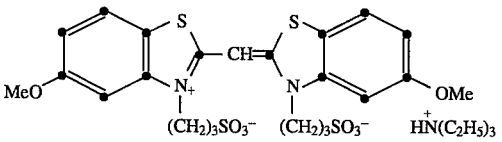

(II)-5

$E_{ox}$ = +1.305 V
$E_{red}$ = −1.451 V

The dyes of formulas (I)–(X) can be prepared according to techniques that are well-known in the art, such as described in Hamer, *Cyanine Dyes and Related Compounds*, 1964 and James, *The Theory of the Photographic Process* 4th, 1977.

The first and second dyes used according to the present invention can be used in any molar ratio that will provide the desired spectral absorbance characteristics and supersensitization. Preferably, the molar ratio of the first dye to the second dye is between 1:1 and 100:1, and more preferably between 5:1 and 20:1. The total level of sensitizing dye to be used according to the invention can be determined by techniques known in the art. Generally, silver halide emulsions are spectrally sensitized with levels of at least 0.1 mmole dye per mole of silver halide.

The silver halide used in the practice of the invention can be of any known type, such as silver bromoiodide, silver bromide, silver chloride, silver chlorobromide, silver iodide, and the like. The silver halide can be doped, such as with Group VIII metal dopants (e.g., iridium, rhodium), as is known in the art. In one preferred embodiment, the dye combinations are used to sensitize silver halide emulsions that are high in chloride, preferably above about 80 mole percent and more preferably above about 95 mole percent. Such high-chloride emulsions are often subjected to rapid processing, which further increases the need for low-staining dyes.

The type of silver halide grain used in the invention is not critical and essentially any type of silver halide grains can be used in the practice of the invention, although since the combinations used according to the present invention are lower staining than prior art supersensitizing dye combinations, they may be advantageously used in combination with tabular grain emulsions, which have greater surface area, allowing for greater amounts of dye to be used, which can aggravate dye stain problems. Tabular silver halide grains are grains having two substantially parallel crystal faces that are larger than any other crystal face on the grain. Tabular grain emulsions preferably have at least 50% of the grain population accounted for by tabular grains that satisfy the formula AR/t>25. In this formula, AR stands for aspect ratio, which equals D/t. D is the diameter of the grain in micrometers and t is the thickness of the grain between the two substantially parallel crystal faces in micrometers. The grain diameter D is determined by taking the surface area of one of the substantially parallel crystal faces, and calculating the diameter of a circle having an area equivalent to that of the crystal face. The grain size of the silver halide may have any distribution known to be useful in photographic compositions, and may be either polydisperse or monodisperse.

The silver halide grains to be used in the invention may be prepared according to methods known in the art, such as those described in *Research Disclosure*, Item 308119, December, 1989 [hereinafter referred to as Research Disclosure I] and Mees, *The Theory of the Photographic Process*. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold and sulfur sensitizers and others known in the art. Compounds and techniques useful for chemical sensitization of silver halide are known in the art and described in *Research Disclosure I* and the references cited therein.

The silver halide may be sensitized by the dyes of formulas (I)–(X) by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (e.g., 2 hours).

The above-described sensitizing dyes can be used by themselves to sensitize silver halide, or they may be used in combination with other sensitizing dyes to provide the silver halide with sensitivity to broader or different ranges of wavelengths of light than silver halide sensitized with a single dye or to further supersensitize the silver halide.

In a preferred embodiment of the invention, the dyes of formulas (I)–(X) are used to sensitize silver halide in photographic emulsions, which can be coated as layers on photographic elements. Essentially any type of emulsion (e.g., negative-working emulsions such as surface-sensitive emulsions or unfogged internal latent image-forming emulsions, direct-positive emulsions such as surface fogged emulsions, or others described in, for example, *Research Disclosure I*.

Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount known to be useful in photographic emulsions.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in Research Disclosure, June, 1975, item 13452 and U.S. Pat. No. 3,772,031.

Other addenda include antifoggants, stabilizers, filter dyes, light absorbing or reflecting pigments, vehicle hardeners such as gelatin hardeners, coating aids, dye-forming couplers, and development modifiers such as development inhibitor releasing couplers, timed development inhibitor releasing couplers, and bleach accelerators. These addenda and methods of their inclusion in emulsion and other photographic layers are well-known in the art and are disclosed in *Research Disclosure I* and the references cited therein.

The emulsion may also include brighteners, such as stilbene brighteners. Such brighteners are well-known in the art and are used to counteract dye stain, although the dyes of formulas (I)–(X) offer reduced dye stain even if no brightener is used.

The emulsion layer containing silver halide sensitized with the dyes of formulas (I)–(X) can be coated simultaneously or sequentially with other emulsion layers, subbing layers, filter dye layers, interlayers, or overcoat layers, all of which may contain various addenda known to be included in photographic elements. These include antifoggants, oxidized developer scavengers, DIR couplers, antistatic agents, optical brighteners, light-absorbing or light-scattering pigments, and the like.

The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

Photographic elements comprising the composition of the invention can be black and white or color. A color photographic element generally contains three silver emulsion layers or sets of layers: a blue-sensitive layer having a yellow color coupler associated therewith, a green-sensitive layer having a magenta color coupler associated therewith, and a red-sensitive layer having a cyan color coupler associated therewith. The photographic composition of the invention can be utilized in any color-sensitive layer of a color photographic element having a dye-forming color coupler associated therewith. These color image-forming couplers along with other element configurations are well-known in the art and are disclosed, for example, in *Research Disclosure I*.

Photographic elements comprising the composition of the invention can be processed in any of a number of well-known photographic processes utilizing any of a number of well-known processing compositions, described, for example, in *Research Disclosure I* or in James, *The Theory of the Photographic Process* 4th, 1977. Elements having high chloride silver halide photographic compositions are especially advantageously processed by fast processes utilizing a so-called rapid access developer.

The invention is described further in the following Example.

EXAMPLE

A 0.25 μm AgBrI (94:6) polymorphic sulfur- and gold-sensitized emulsion was spectrally sensitized at 0.8 mmole/mole Ag of a dye (I) and 0.08 mmole/mole Ag of a dye (II), or with combinations including comparison dyes A or B (structures shown below). The dyes were added one at a time at 40° C. as methanol solutions with a 20 minute hold time for each.

The spectrally sensitized emulsions were coated at 0.81 g Ag/m$^2$ with 1.62 g/m$^2$ of the cyan dye-forming coupler 5-(α-(2,4-di-t-amylphenoxy)-hexanamido)-2-heptafluorobutylamido phenol, 25.2 g/m$^2$ 5-bromo-4-hydroxy-6-methyl-1,3,3a,7-tetraazaindene, and 2.37 g/m$^2$ gelatin on a cellulose acetate support. The coatings were overcoated with 2.37 g/m$^2$ gelatin and hardened with 1.55% bis(vinylsulfonyl)methyl ether by weight based on total gelatin content.

-continued $E_{ox}$ = +0.996 V
$E_{red}$ = −1.023 V

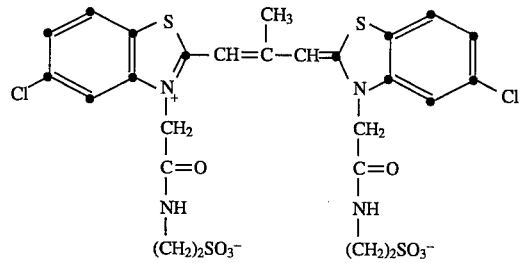

B $E_{ox}$ = +0.951 V
$E_{red}$ = −1.056 V

These photographic materials were exposed through a 0 to 4.0 density step tablet (0.2 density steps) and a Wratten® 23A filter to a 5500° K. light for 0.02 second and were developed in a hydroquinone and N-methyl-p-aminophenol sulfate developer at 20° C. for 6 min. The resultant black and white densities were read through a visual filter. Relative speed, in log E units multiplied by 100, was determined at 0.15 density units above fog. Retained dye stain was measured by reading total transmission densities as a function of visible wavelengths. The density and peak wavelength in the unexposed region of the material are given as the stain values in the Table below. When the stain peak was too broad to isolate, overall densities are given. $\Delta E_{ox}$ values in the table represent the calculated $E_{ox}$ of the first dye minus the calculated $E_{ox}$ of the second dye. $\Delta E_{red}$ values in the table represent the calculated $E_{red}$ of the first dye minus the calculated $E_{red}$ of the second dye.

| COATING | | FIRST DYE | SECOND DYE | $\Delta E_{ox}$ | $\Delta E_{red}$ | STAIN | STAIN PEAK (nm) | FOG | RELATIVE SPEED | Δ SPEED (from control) |
|---|---|---|---|---|---|---|---|---|---|---|
| 1 | Control | A | | — | — | 0.058 | 562.4 | 0.05 | 110 | 0 |
| 2 | Comparison | A | (I)-1 | −0.016 | −0.020 | 0.062 | 563.4 | 0.05 | 116 | 6 |
| 3 | Comparison | A | (I)-2 | −0.029 | −0.073 | 0.061 | 566.3 | 0.04 | 122 | 12 |
| 4 | Comparison | A | (II)-1 | +0.103 | +0.072 | 0.063 | 564.8 | 0.04 | 133 | 23 |
| 5 | Comparison | A | (II)-2 | +0.127 | +0.045 | 0.065 | 567.0 | 0.04 | 134 | 24 |
| 6 | Comparison | A | B | +0.045 | +0.033 | 0.061 | 570.6 | 0.05 | 113 | 3 |
| 7 | Comparison | A | (II)-3 | +0.091 | −0.020 | 0.063 | 568.4 | 0.05 | 124 | 14 |
| 8 | Control | (I)-1 | | — | — | 0.050 | | 0.04 | 119 | 0 |
| 9 | Comparison | (I)-1 | A | +0.016 | +0.020 | 0.049 | | 0.03 | 124 | 5 |
| 10 | Comparison | (I)-1 | (I)-2 | −0.013 | −0.053 | 0.047 | | 0.04 | 125 | 6 |
| 11 | Invention | (I)-1 | (II)-1 | +0.119 | +0.092 | 0.047 | | 0.04 | 142 | 23 |
| 12 | Invention | (I)-1 | (II)-2 | +0.143 | +0.065 | 0.053 | 573.0 | 0.04 | 143 | 24 |
| 13 | Comparison | (I)-1 | B | +0.061 | +0.053 | 0.048 | | 0.04 | 120 | 1 |
| 14 | Invention | (I)-1 | (II)-3 | +0.107 | 0.000 | 0.047 | | 0.03 | 132 | 13 |
| 15 | Control | (I)-2 | | — | — | 0.052 | | 0.04 | 95 | 0 |
| 16 | Comparison | (I)-2 | A | +0.029 | +0.073 | 0.058 | 601.2 | 0.04 | 109 | 14 |
| 17 | Comparison | (I)-2 | (I)-1 | +0.013 | +0.053 | 0.054 | 560.0 | 0.04 | 110 | 15 |
| 18 | Invention | (I)-2 | (II)-1 | +0.132 | +0.145 | 0.055 | 566.9 | 0.04 | 132 | 37 |
| 19 | Invention | (I)-2 | (II)-2 | +0.156 | +0.118 | 0.063 | 598.5 | 0.05 | 129 | 34 |
| 20 | Comparison | (I)-2 | B | +0.074 | +0.106 | 0.654 | 568.5 | 0.04 | 109 | 14 |
| 21 | Invention | (I)-2 | (II)-3 | +0.120 | +0.053 | 0.054 | 566.7 | 0.04 | 128 | 33 |

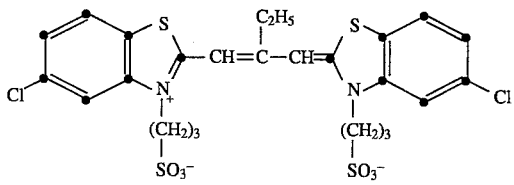

A

In this table, comparison of the speed and Δ speed data within each control set demonstrates that the dye combinations according to the invention provide significantly greater supersensitization than the comparison dye combinations not having the oxidation and reduction potential differential chosen according to the invention. This is seen, for example, by comparing coatings 11, 12, and 14 of the invention versus comparison coatings 9, 10, and 13, and by comparing coatings 18, 19, and 21 of the invention versus comparison coatings 16, 17, and 20. The stain advantage of the invention is demonstrated by comparing the stain data for the first control set using dye A as the first dye (coatings 1–7) versus the second control set using dye (I)-1 as the first dye (coatings 8–14) or versus the third control set using dye (I)2 as the first dye (coatings 15–21). The data in the table demonstrates that both supersensitization and low stain are achieved only when the first dye is chosen according to formula (I) and the two dyes have relative oxidation and reduction potentials as specified according to the present invention.

The invention has been described in detail with particular reference to preferred embodiments thereof, but it will be understood that variations and modifications can be effected within the spirit and scope of the invention.

What is claimed is:

1. A photographic element comprising a support having thereon a silver halide emulsion layer spectrally sensitized with a supersensitizing combination of a first dye having the formula:

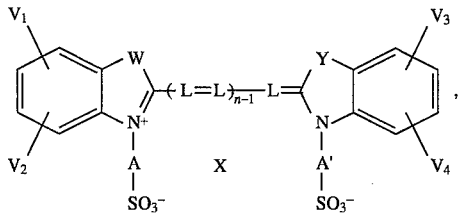

and a second dye having the formula:

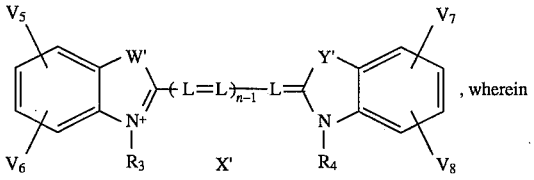

, wherein

W, W', Y, and Y" each independently represents O, S or N—$R_1$ where $R_1$ represents alkyl, $V_1$, $V_2$, $V_3$, and $V_4$ each independently represents H, halogen, aryl, $CF_3$, cyano, sulfonyl, acyl, or carbamoyl, $V_5$, $V_6$, $V_7$, and $V_8$ each independently represents H, alkyl, methoxy, ethoxy, acetoxy, hydroxy, acetamido, amino, or $V_5$ and $V_6$ or $V_7$ and $V_8$ together form a methylenedioxy group, with the proviso that if $V_1$, $V_2$, $V_3$, and $V_4$ are all H, then $V_5$, $V_6$, $V_7$, and $V_8$ are not all H, n is 2 or 3, each L represents an unsubstituted methine group or a methine group substituted with a phenyl or a 1 to 6 carbon alkyl;

X represents a cation as needed to balance the charge of the molecule,

X' represents a counterion as needed to balance the charge of the molecule,

A and A' each independently represents a divalent linking group such that at least one of H—A—$SO_3H$ and H—A'—$SO_3H$ has a log P value that is more negative than about −0.3, $R_3$ and $R_4$ each independently represents an alkyl of from 1 to 6 carbon atoms, or an aryl of from 6 to 15 carbon atoms, either of which is unsubstituted or substituted with a hydroxy, alkoxy, carboxy, sulfo, sulfato, acyloxy, alkoxycarbonyl or aryl, or represents a p-chlorophenyl, and the second dye has an oxidation potential that is at least about 0.08 volts less positive than the oxidation potential of the first dye and a reduction potential that is equal to or more negative than the reduction potential of the first dye when the oxidation and reduction potentials of said first and second dyes are calculated through the use of Brooker deviations.

2. A photographic element according to claim 1, wherein the molar ratio of said first dye to said second dye is between 1:1 and 100:1.

3. A photographic element according to claim 1 wherein the molar ratio of said first dye to said second dye is between 5:1 and 20:1.

4. A photographic element according to any of claims 1, 2, or 3 wherein A and A' each independently represents a divalent linking group such that at least one of H—A—$SO_3H$ and H—A'—$SO_3H$ has a log P value that is more negative than about −1.0.

5. A photographic element according to any of claims 1, 2 or 3 wherein —A— and —A'— each independently contains a hydroxy group, an amide group, an ether group, a carboxylic ester group, a sulfonamide group, a urea group, a sulfonyl group, a sulfoxide group, or a urethane group.

6. A photographic element according to any of claims 1, 2 or 3 wherein the second dye has an oxidation potential of at least about 0.1 volts less positive than the first dye and a reduction potential more negative than the first dye.

7. A photographic element according to claim 1 wherein said first dye has the formula:

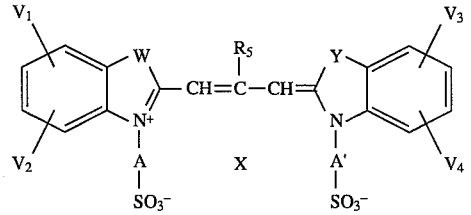

and said second dye has the formula:

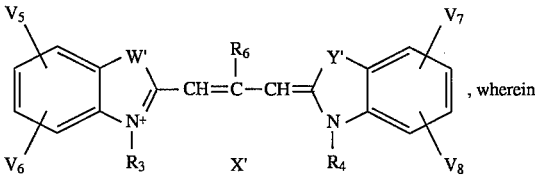

, wherein at least one of W and Y and at least one of W' and Y' is S, and $R_5$ and $R_6$ each independently represents H, a 1 to 6 carbon alkyl, or phenyl.

8. A photographic element according to claim 1 wherein each of H—A—$SO_3H$ and H—A'—$SO_3H$ has a log P value that is more negative than about −0.3.

9. A photographic element according to claim 1 wherein the silver halide of the silver halide emulsion layer has a halide content of at least 80 mole % chloride.

10. A photographic element comprising a support having thereon a silver halide emulsion layer in which the halide content of the silver halide is at least 80 mole % chloride, and which is spectrally sensitized with a supersensitizing combination of a first dye according to the formula:

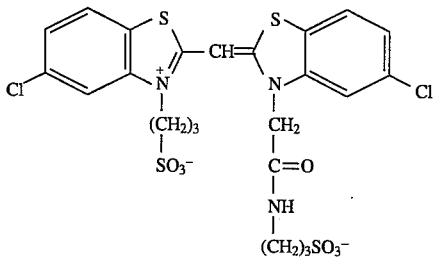
X
and a second dye according to the formula:
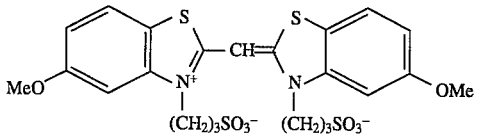
X'
wherein X and X' are cations to balance the charge of the molecule.
* * * * *